United States Patent [19]

El-Souessi

[11] 4,265,172

[45] May 5, 1981

[54] SELECTIVE DRUM SERIES MARKING HEAD

[76] Inventor: Monti El-Souessi, 632 Stoops Ferry Rd., Coraopolis, Pa. 15108

[21] Appl. No.: 44,863

[22] Filed: Jun. 4, 1979

[51] Int. Cl.[3] ..... B41J 1/32

[52] U.S. Cl. ..... 101/29; 101/110

[58] Field of Search ..... 101/93.22, 29, 18–21, 101/42, 43, 95, 99, 110, 85, 79, 327–333

[56] References Cited

U.S. PATENT DOCUMENTS

| | | | |
|---|---|---|---|
| 1,282,173 | 10/1918 | Besaw et al. | 101/110 |
| 1,968,900 | 8/1934 | Naugler | 101/110 |
| 2,073,154 | 3/1937 | Hoffman | 101/29 |
| 2,151,230 | 3/1939 | Putnam et al. | 101/110 |
| 2,232,528 | 2/1941 | Hoffman | 101/29 X |
| 2,274,595 | 2/1942 | Edwards | 101/29 X |
| 2,801,583 | 8/1957 | Loushay | 101/42 X |
| 4,006,786 | 2/1977 | Speicher | 101/3 R X |

FOREIGN PATENT DOCUMENTS

| | | | |
|---|---|---|---|
| 477427 | 12/1937 | United Kingdom | 101/85 |

*Primary Examiner*—Edward M. Coven
*Attorney, Agent, or Firm*—Edward L. Levine

[57] ABSTRACT

A numbering head particularly adaptable to a portable gun including a frame having flat surfaces for seating against a flat workpiece. A shaft is positioned parallel to the seating surfaces and is supported within elongated apertures which allow the shaft, and marking wheels disposed on the shaft, to move through a limited length of travel toward, and away from, the workpiece. Each marking wheel includes, about its periphery, marking characters separated by grooves, each groove being disposed directly across from a corresponding character. A generally T-shaped yoke is supported within the frame and is matingly shaped to the grooves in the wheels. Biasing springs acting between the yoke and frame force the yoke into contact with the marking wheel grooves. A portion of the yoke extends into, or through, an opening in the frame. The opening is threaded to provide attachment of the numbering head to a portable gun, or a fixed or portable press, and to align the hammer of the gun or press with the yoke. Upon actuation the hammer impacts upon the yoke, the force being transmitted from the yoke to the wheels and the workpiece. The elongated aperture ensures that the force is transmitted to the workpiece without being diluted by contact of the shaft and frame.

8 Claims, 17 Drawing Figures

SELECTIVE DRUM SERIES MARKING HEAD

BACKGROUND OF THE INVENTION

1. Field of the Invention

This invention relates to marking tools and more particularly to a numbering head with marking wheels for portable hand-held marking guns.

2. Description of the Prior Art

Portable marking tools for impressing a mark on a workpiece, such as those utilizing forces developed by springs or explosive cartridges, are well known. While, with the use of sufficiently large biasing or explosive forces, adequate marking is achieved, the conventional devices are not without limitations regarding the ease and efficiency of the marking process, the amount of power transmitted through the various components in the marking train, and the inability of prior devices to effectively utilize marking wheels in a portable device.

For example, prior devices may require the operator to hold the actual marking character against the workpiece which can result in an unbalanced orientation and uneven marking, particularly if the device must be used in a space limited environment. Additionally, conventional devices typically require a relatively large number of components in the power train, requiring excessive initiating forces and providing greater likelihood of component failure from the impact forces. And, prior devices require multiple time consuming operations to change the marking elements where, for example, sequential markings are desired.

It is thus desirable to provide a numbering head adaptable to hand-held impact devices which alleviates these, and other limitations, of prior marking tools.

SUMMARY OF THE INVENTION

This invention provides a numbering head readily adaptable to portable impact apparatus which alleviates the above-discussed limitations of the prior art. In a preferred form the device includes a channel shaped frame, herein described as including a base and two prongs. The exposed tips of the prongs are preferably flat and, in operation, provide a flat surface which positively seats against the workpiece to be marked. The cross sectional area of the flat seating surfaces is preferably larger than the cross sectional area of the prongs at the base of the channel to provide operational stability and increased structural strength.

Apertures are disposed through the prongs so as to support a shaft parallel to the base of the channel. The apertures are enlarged relative to the shaft, being generally elliptical, allowing limited, controlled movement of the shaft toward, and away from, the workpiece. A plurality of marking wheels are mounted on the shaft having characters disposed about the periphery and separated by grooves. A groove is disposed directly opposite each character. The components are sized so that the characters do not extend beyond the flat surfaces when the shaft is in the rear portion of the apertures, that portion away from the workpiece.

The base of the frame includes an aperture, perpendicular to the shaft. The aperture is threaded to provide connection to an impact gun, and also to provide for passage of an impact force transmitting component, such as a hammer. A generally T-shaped yoke is movably seated within the frame, the top of the T being parallel to the shaft and the single leg of the T extending freely into or through the aperture. The top of the T is matingly configured to the grooves in the marking wheels and the exposed end of the single leg is preferably flat to receive impact from the hammer. Biasing means, such as coil springs, extend between receptacles in the base of the frame and in the yoke, biasing the yoke into contact with the grooves of the marking wheels. The yoke is structured to allow disengagement of the yoke and marking wheels to allow for advancement of the wheels. This arrangement can include a notch in the yoke accessible to the operator.

To utilize the numbering head it is affixed, through the threaded aperture, to an impact gun. The yoke, through, for example, action on the notch, is moved away from the wheel grooves and the wheels are rotated to position the desired characters. The yoke is then released, being held in position against the wheel grooves by the springs. This places the shaft in the forward position of the elongated apertures, and the characters beyond the flat seating surfaces of the frame extensions.

The operator then places the seating surfaces at the desired position against the workpiece, rearwardly displacing the wheels, and accordingly the shaft is moved to a rearward position in the elongated apertures. Upon firing, the hammer of the impact device impacts upon the yoke, and the force is transmitted directly from the yoke to the wheels and the workpiece, impressing the characters upon the workpiece. The shaft preferably does not, at this point, contact the front edge of the elongated apertures. It is only after recoil and removal of the flat surfaces from the workpiece that the biasing force moves the shaft to the front of the elongated apertures.

In this manner the impact force is directly transmitted through the power train components, and not through the relatively massive frame.

BRIEF DESCRIPTION OF THE DRAWINGS

The advantages, nature and additional features of the invention will become more apparent from the following description, taken in connection with the accompanying drawings, in which.

DESCRIPTION OF THE PREFERRED EMBODIMENTS

Figure 1:
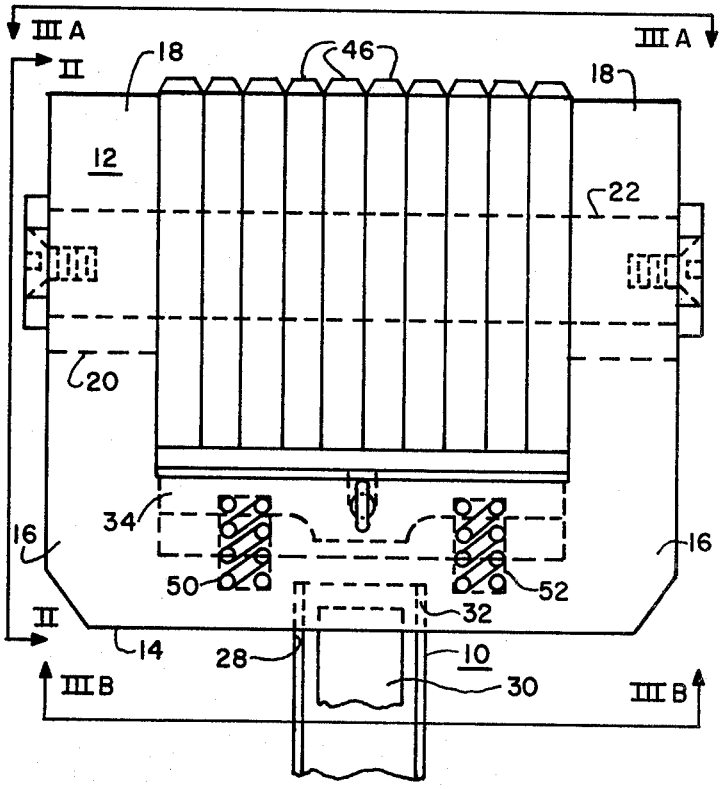
FIG. 1 is a side view of a numbering head in accordance with the invention.
Figure 9:
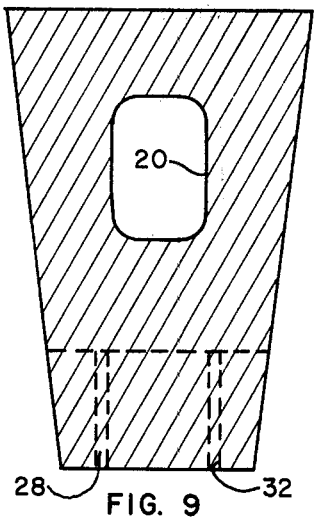
FIG. 9 is a view of an alternate configuration of a portion of the frame of a numbering head in accordance with the invention.

Referring now to FIG. 1 there is shown a preferred numbering head 10 adaptable to an impact device such as a portable spring or explosively loaded gun. The numbering head 10 includes a frame 12 which is shaped as a channel having a base 14 and two prongs 16. As shown in FIGS. 2 and 9, the prongs 16 are preferably generally trapezoidal, being enlarged at the tips 18. The prongs 16 can also be rectangular or of other convenient shape. The tips 18 are flat, forming a seating surface for the numbering head 10 against a workpiece to be marked. In the event the workpiece is not flat, the tips 18 can be matingly shaped to properly seat against the workpiece.

Figure 4:
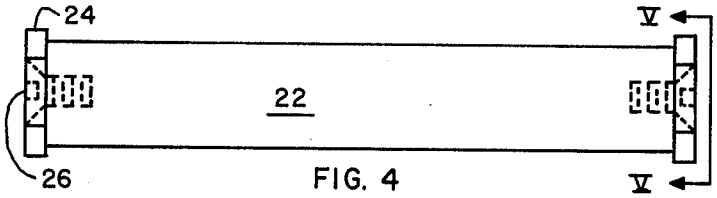
FIG. 4 is a view of a shaft in accordance with the invention.
Figure 5:
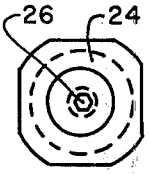
FIG. 5 is a view taken at V—V of FIG. 4.
Figure 6C:
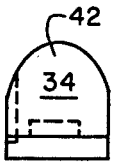
Figure 7A:
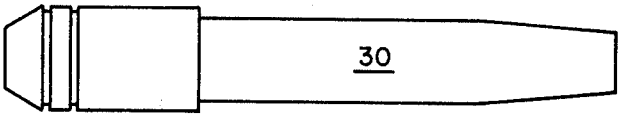
FIGS. 7A and 7B are respectively side and end views of an impact hammer.
Figure 7B:
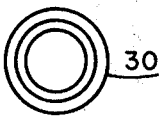

Disposed through each prong 16 is an aperture 20 which receives a shaft 22. The apertures 20 and shaft 22 are sized to allow limited, controlled motion of the shaft 22 within the apertures 20. The apertures 20 are thus elongated, and generally elliptical, preferably having semi-circular ends joined by straight portions. The shaft 22 includes a restraining member 24 at each end, one or both of which are removably affixed to the shaft by a fastener 26. The restraining members 24 (FIGS. 4 and 5) are larger than the narrow dimension of the apertures 20, and maintain the shaft 22 parallel to the flat seating surfaces 18 during motion within the aperture 20.

Figure 10:
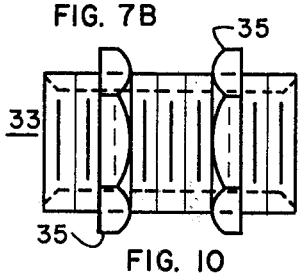
FIG. 10 is a plan view of an adaptor in accordance with the invention.

The base 14 of the frame includes an aperture 28 through which a hammer 30 of an impact device (not shown) passes. The aperture 28 can also comprise threads 32 so as to form the connection between the numbering head 10 and the impact device, either directly or through, for example, a threaded insert. A preferred threaded adaptor 33, including two lock nuts 35, is shown in FIG. 10. Other means of rigidly affixing the numbering head 10 to the barrel or other portion of a portable impact device are equally possible.

Figure 8A:
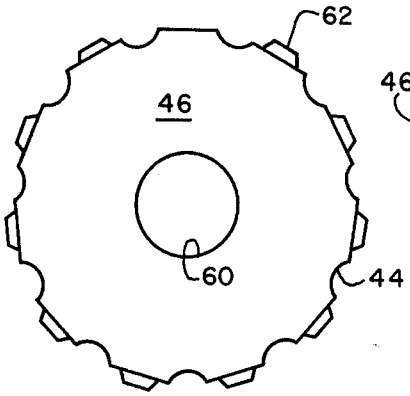
FIGS. 8A and 8B are respectively plan and side views of a marking wheel in accordance with the invention.
Figure 8B:
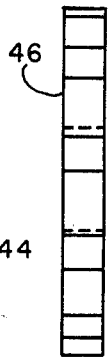
Figure 6A:
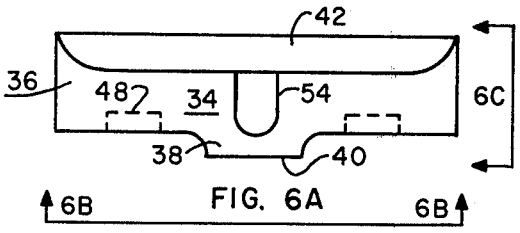
FIGS. 6A, 6B and 6C are respectively elevation, bottom plan, and side views of a yoke in accordance with the invention.
Figure 6B:
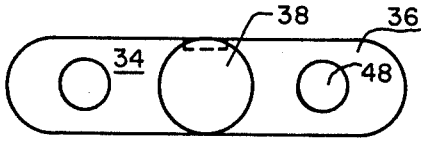
Figure 3A:
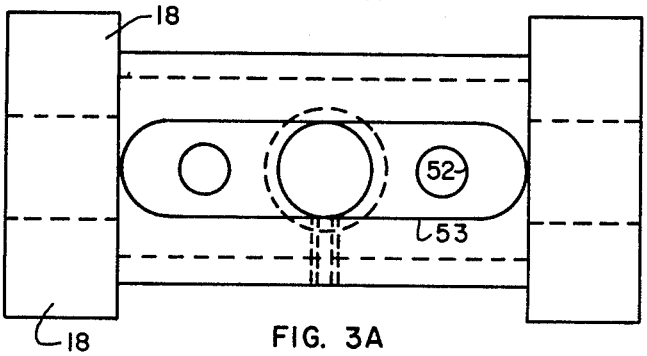
FIGS. 3A and 3B are respectively top and bottom views of the frame of the numbering head corresponding to IIIA—IIIA and IIIB—IIIB of FIG. 1 with selected components removed.
Figure 3B:
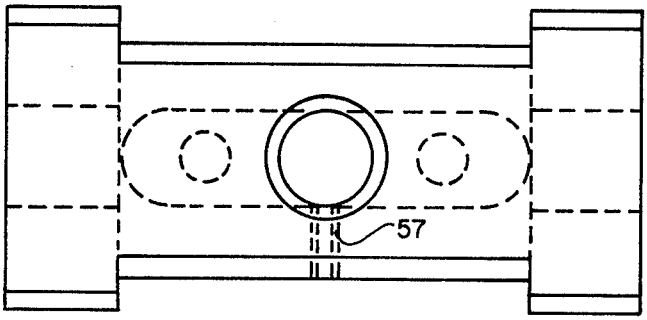

Fitted to move within the bottom of the channel shaped frame 12 is a yoke 34 (FIGS. 1, 6A, 6B and 6C) which, in preferred form, is generally T shaped, having a top portion 36 and a single leg 38. The single leg 38 is aligned with the aperture 28 and is preferably flat on its surface 40 which receives the impact of the hammer 30. The top portion 36 is shaped, preferably with an arcuate tip 42, to matingly engage grooves 44 in marking wheels 46 (FIGS. 8A and 8B). The yoke 34 also includes receptacles 48 within which are disposed means for biasing the yoke 34 relative to the frame 12, such as coil springs 50 (FIG. 1). The opposite end of each spring 50 is seated within receptacles 52 in the base 14 of the frame 12. Other means for biasing the yoke are equally possible, for example, a spring of larger diameter than the aperture 28 disposed about the single leg 38 of the yoke 34. As shown best in FIG. 3, the yoke 34 seats within a slot 53 in the base 14 of the frame 12.

Means are provided for maintaining the yoke 34 in a rear position against the biasing force of the springs 50 so as to allow for free rotation of the marking wheels 46 to a desired position. This structure can include a notch 54 in the yoke 34 and a wing nut 55 threaded through the frame 12 and positioned to engage the notch 54. In this manner the operator can, for example, push the wheels 46 against a flat surface so as to rearwardly move the wheels 46, shaft 22 and yoke 34, and temporarily lock the yoke 34 in place by the wing nut 55. With the yoke thus fixed in place the wheels and shaft can be moved forward and the wheels readily rotated.

The marking wheel 46 includes a central opening 60 sized to closely fit over the shaft 22, having sufficient clearance for assembly. About the periphery of each wheel are characters 62 spaced by the grooves 44. A groove 44 is disposed 180° from each respective character 62. If the workpiece to be marked is other than flat, the outermost edges of the characters 62 can be matingly shaped to the workpiece. The total number of wheels 46 used preferably fills the lateral space between the prongs 16, as shown in FIG. 1.

Figure 2A:
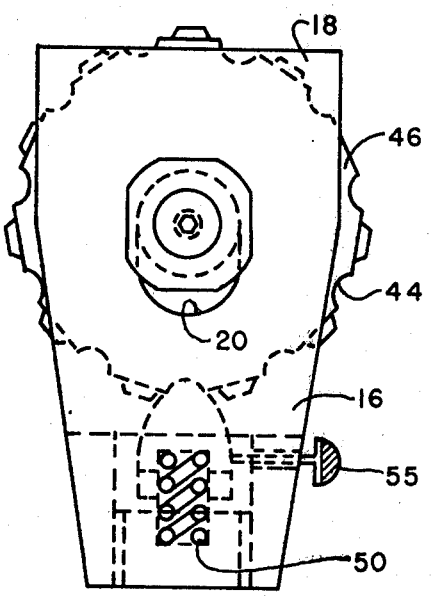
FIGS. 2A, 2B and 2C are views taken at II—II of FIG. 1, showing the numbering head in three respective operational positions.
Figure 2B:
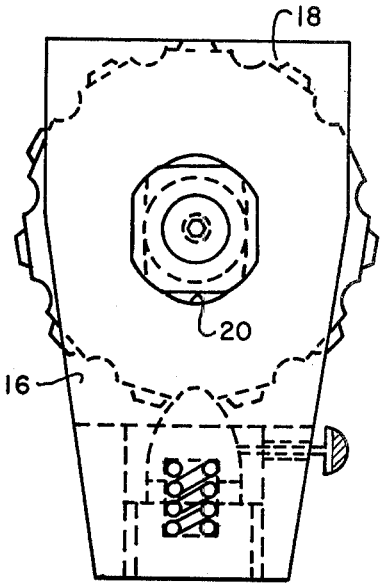
Figure 2C:
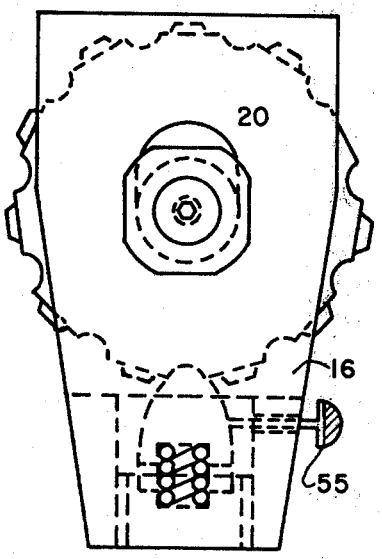

Operation of the numbering head will now be described with particular reference to the positions shown in FIGS. 2A, 2B and 2C. FIG. 2A shows the position of the unrestrained components, the springs 50 exhibiting a force on the yoke 34 so that the yoke 34, the wheels 46 and the shaft 22 are all in a forward position. The forward position is limited by contact of the shaft 22 and the forward portion of the elongated apertures 20. The operator then places the surfaces 18 against the workpiece, which overcomes the biasing force and positions the outermost edges of the characters 62 flush with the surfaces 18, as shown in FIG. 2B. In this orientation the numbering head 10 is properly aligned with respect to the workpiece, by the surfaces 18, so as to ensure an evenly distributed impact force.

Upon activating the impact gun, the hammer 30 strikes the yoke 34 which directly transfers the impact force, through the wheels 46, to the workpiece. It will be noted that in the impact position, a position between that shown in FIGS. 2A and 2B, the relative position of the shaft 22 and frame 12 is such that the shaft has not yet moved to its forward-most position in the elongated aperture 20. In this manner the impact force is not diluted through interaction with the relatively massive frame 12. Subsequent to impact which imprints the desired mark, the shaft moves to the recoil position shown in FIG. 2C and, finally to the unrestrained position shown in FIG. 2A, upon the surfaces 18 having been removed from the workpiece. Dependent upon operator response, the recoil position, FIG. 2C, may not be reached other than when the operator specifically places the yoke in its rearmost position for rotation of the marking wheels.

While the total travel distance of the shaft and other components can be adjusted dependent upon the tensile strength of the workpiece material, the size of the wheels, the numbering head and the impact force desired, in the exemplary embodiment shown, the full size of the wheel is 60 mm diameter, the shaft 18 mm diameter, and the apertures 20 being 18 mm (plus tolerance) in the short dimension and 23 mm in the long dimension. This provides a total of 5 mm travel. The depth of each character is 1.1 mm. It can be seen that the length of travel is larger than the depth of the characters, which provides that the impact is not taken through the frame. It is only subsequent to making the marking that the shaft is seated against the extremities of the elongated aperture.

It will also be apparent that the floating yoke secures the marking wheels in the desired position, and that the impact train is direct, through the yoke and into the marking wheels.

While there has been described a numbering head by way of specific preferred example, it will be apparent that many modifications and additions are possible without departing from the spirit and scope thereof. For example, the marking head can readily be utilized for marking by means other than impact impression, such as pressure marking, and other means for providing a force upon the yoke, such as hydraulic, pneumatic, and mechanical loading devices, can also be utilized. The marking head is also readily adaptable to fixed apparatus, such as a press. Additionally, the shaft and mating structures can be of various geometrical shapes, such as that shown in FIG. 9, so long as the apertures supporting the shaft allow sufficient controlled motion. It therefore is intended that all matter contained in the foregoing description and accompanying drawings is to be taken as illustrative, and not in a limiting sense.

I claim:

1. A numbering head, for impressing a mark upon a workpiece, adaptable to a device having a force transmitting movable hammer, comprising:

a. a frame having a base and two spaced prongs, said prongs each including an elongated aperture and being positionable against a workpiece, said base including an aperture therethrough;

b. a shaft supported from said prong apertures sized and disposed for sliding motion in the direction of the elongation of said prong apertures;

c. a plurality of marking wheels supported on said shaft between said prongs;

d. a yoke disposed within said frame including a first portion contactable with said marking wheels and a second portion aligned with said base aperture;

e. means for biasing said yoke into contact with said wheels; and f. means for affixing said frame to said force transmitting device such that, with said prongs positioned against a workpiece, force is transmitted by said hammer to said second portion of said yoke, said force being transmitted through said base aperture, said force being further transmitted from said yoke to said wheels and to said workpiece.

2. A numbering head adaptable to a device having a force transmitting movable hammer, said numbering head comprising:

a. a channel-shaped frame having a base and two prongs, said prongs each having an elongated aperture therethrough, said base having an aperture therethrough, said prongs having aligned tips for seating against a workpiece;

b. a shaft slidably supported within said prong apertures movable in the direction of the elongation of said apertures;

c. a marking wheel disposed about said shaft having a plurality of peripheral characters and a groove disposed opposite each said character;

d. a yoke movably supported within said frame including a surface matingly configured to said grooves and a tip aligned with said base aperture and positioned for contact by said hammer so as to transmit a force through said base aperture;

e. means for biasing said configured surface of said yoke into mating contact with said groove;

f. one of said peripheral characters being selectively impressible upon said workpiece upon said hammer transmitting a force through said yoke to said wheel; and g. said numbering head being sized such that upon impression of said selected peripheral character upon said workpiece, said shaft is spaced from the ends of said elongated apertures.

3. The numbering head of claim 2 wherein each said elongated prong aperture is shaped as two semi-circular arcs joined by straight sections and wherein said shaft is of circular cross section.

4. The numbering head of claim 2 wherein each said prong is generally trapezoidal in shape, being of smaller cross section at said base than at its opposite end.

5. The numbering head of claim 2 further comprising means for selectively fixing said yoke in position relative to said frame.

6. The numbering head of claim 5 wherein said fixing means comprise structure threaded through said frame and contactable with said yoke.

7. The numbering head of claim 2 wherein said frame, elongated apertures, biasing means, yoke, shaft and wheel are sized such that (i) when unrestrained, said selected peripheral character extends beyond a plane formed by said aligned tips of said prongs; and (ii) when said aligned tips are seated against said workpiece, said selected peripheral character is also seated against said workpiece.

8. A numbering head adaptable to a portable impact device having a movable force transmitting hammer, said numbering head comprising:

a. a shaft;

b. a marking wheel supported about said shaft having a plurality of peripheral marking characters and, for each said character, an oppositely disposed peripheral groove;

c. a channel-shaped frame having a base and two prongs, aligned elongated apertures in said prongs for slidably supporting said shaft, and an opening through the base of said channel, said prongs having aligned tips for seating against a workpiece;

d. a yoke movably seated within said frame having a surface sized and positionable to seat within said grooves and an opposite surface aligned with said opening of said base and contactable by said hammer;

e. means for biasing said yoke into contact with said wheel; and f. means for rigidly affixing said frame to said portable impact device such that said hammer is aligned for passage into said opening of said frame;

g. one of said peripheral characters being selectively impressible upon said workpiece upon said hammer transmitting a force through said yoke to said wheel;

h. said numbering head being sized such that upon impression of said selected peripheral character upon said workpiece, said shaft is spaced from the ends of said elongated apertures; and i. said frame, elongated apertures, biasing means, yoke, shaft and wheel being sized such that (i) when unrestrained, said selected peripheral character extends beyond a plane formed by said aligned tips of said prongs; and (ii) when said aligned tips are seated against said workpiece, said selected peripheral character is also seated against said workpiece.

* * * * *